US011078560B2

(12) United States Patent
Kang et al.

(10) Patent No.: US 11,078,560 B2
(45) Date of Patent: Aug. 3, 2021

(54) SYSTEM AND METHOD FOR APPLYING AMORPHOUS METAL COATINGS ON SURFACES FOR THE REDUCTION OF FRICTION

(71) Applicant: CORNERSTONE INTELLECTUAL PROPERTY, LLC, Lake Forest, CA (US)

(72) Inventors: John Kang, Lake Forest, CA (US); Evelina Vogli, Lake Forest, CA (US); Ricardo Salas, Lake Forest, CA (US)

(73) Assignee: CORNERSTONE INTELLECTUAL PROPERTY, LLC, Lake Forest, CA (US)

( * ) Notice: Subject to any disclaimer, the term of this patent is extended or adjusted under 35 U.S.C. 154(b) by 0 days.

(21) Appl. No.: 16/599,138

(22) Filed: Oct. 11, 2019

(65) Prior Publication Data

US 2021/0108299 A1 Apr. 15, 2021

(51) Int. Cl.

| | |
|---|---|
| ***C22C 45/02*** | (2006.01) |
| ***C22C 45/04*** | (2006.01) |
| ***C23C 4/08*** | (2016.01) |
| ***C22C 45/00*** | (2006.01) |
| ***E21B 17/10*** | (2006.01) |
| *E21B 7/04* | (2006.01) |

(52) U.S. Cl.

CPC ..... *C22C 45/008* (2013.01); *C22C 45/02* (2013.01); *C22C 45/04* (2013.01); *C23C 4/08* (2013.01); *E21B 17/1085* (2013.01); *C22C 2200/02* (2013.01); *E21B 7/046* (2013.01)

(58) Field of Classification Search

None

See application file for complete search history.

(56) References Cited

U.S. PATENT DOCUMENTS

| | | | | |
|---|---|---|---|---|
| 5,376,191 | A * | 12/1994 | Roman | C22C 45/008 148/403 |
| 5,589,012 | A * | 12/1996 | Hobby | C22C 45/10 148/403 |
| 5,643,531 | A * | 7/1997 | Kim | C22C 38/32 148/326 |
| 2010/0044110 | A1 * | 2/2010 | Bangru | E21B 7/046 175/61 |

FOREIGN PATENT DOCUMENTS

WO WO-2018/067989 A1 * 4/2018

* cited by examiner

*Primary Examiner* — George Wyszomierski

(74) *Attorney, Agent, or Firm* — Dave Law Group LLC; Raj S. Dave

(57) ABSTRACT

An embodiment relates to a composition comprising an amorphous alloy having a low coefficient of friction (COF) of 0.15 or less, wherein the amorphous alloy is substantially free of phosphor (P) and substantially free of boron (B). An embodiment relates to a method comprising solidifying a molten layer of an amorphous feedstock on a preexisting layer by controlling a heating source and a cooling rate so as to avoid formation of crystals in the molten layer and not affect a crystalline structure of the preexisting layer, and forming a specimen; wherein, the at least a portion specimen has the low COF. Another embodiment relates to a system comprising a drill string, wherein the drill string comprises a drilling bit and a drill pipe connected thereto, wherein at least a portion of the drill pipe comprises a coating having the low COF.

16 Claims, 4 Drawing Sheets

MEDIUM-RADIUS ANGLE BUILDING ASSEMBLY HORIZONTAL DRILLING ASSEMBLY

MEDIUM-RADIUS ANGLE BUILDING ASSEMBLY

HORIZONTAL DRILLING ASSEMBLY

SYSTEM AND METHOD FOR APPLYING AMORPHOUS METAL COATINGS ON SURFACES FOR THE REDUCTION OF FRICTION

TECHNICAL FIELD

The presently disclosed embodiments generally relate to the application of amorphous metal coatings to reduce friction on applied surfaces; more particularly, amorphous metal alloy coating compositions are disclosed, where application of the coatings reduce friction levels beneath that otherwise achievable by conventional, e.g., non-amorphous, coatings in implementations concerning bends in piping as related to the oil and gas industry, or mining and excavation more generally.

BACKGROUND

Compared to metallic alloy materials with a crystalline microstructure, "i[t] is widely known that metallic glasses [e.g., also referred to as "amorphous metals"] are solid alloys [that] [exhibit] many superior properties", where "[t]he unique properties [of metallic glasses] originate from [their] random atomic arrangement . . . that contrasts with the regular atomic lattice arrangement found in crystalline alloys." [Source: "Classification of Bulk Metallic Glasses by Atomic Size Difference, Heat of Mixing and Period of Constituent Elements and Its Application to Characterization of the Main Alloying Element"; Takeuchi, A.; Inoue, A.; *Materials Transactions*, Vol. 46, No. 12 (2005) pp. 2817 to 2829].

And, "[t]he mechanical properties of amorphous alloys have proven both scientifically unique and of potential practical interest . . . etc." [Source: Mechanical behavior of amorphous alloys"; Schuh, C.; Hufnagel, T.; Ramamurty, U.; Acta Materialia 55 (2007) 4067 4109]. Further, "[t]he mechanics of metallic glasses have proven to be of fundamental scientific interest for their contrast with conventional crystalline metals, and also occupy a unique niche compared with other classes of engineering materials. For example, amorphous alloys generally exhibit elastic moduli on the same order as conventional engineering metals . . . but have room-temperature strengths significantly in excess of those of polycrystals with comparable composition . . . . The consequent promise of high strength with non-negligible toughness has inspired substantial research effort on the room-temperature properties of metallic glasses." [Source: Mechanical behavior of amorphous alloys"; Schuh, C.; Hufnagel, T.; Ramamurty, U.; Acta Materialia 55 (2007) 4067 4109].

The current process of manufacturing amorphous alloys includes cooling a deposit of liquid metal alloy into a solid state, forming an amorphous metal where "the structure of the glass resembles that of the liquid, while its mechanical properties are those of a solid." [Source: "Wear resistance of amorphous alloys and related materials"; Greer, A. L.; Rutherford, K. L.; Hutchings, I. M.; International Materials 47, 87 112]. The friction coefficient of the resulting alloy would range from 0.015 up to 0.9. [See Table 1; source: "Wear resistance of amorphous alloys and related materials"; Greer, A. L.; Rutherford, K. L.; Hutchings, I. M.; International Materials 47, 87 112]. However, the alloy would not be amorphous from time zero (that is, the moment of deposition), and had to undergo hours of friction stress to become truly amorphous, therefore performing worse than other materials due to lack of hardness and wear resistance.

Table 1. Survey of Tribological Studies of Amorphous Alloys and Related Materials (Excluding Quasicrystals), in Rough Chronological Order

TABLE 1

Survey of tribological studies of amorphous alloys and related materials (excluding quasicrystals), in rough chronological order
Table 1 Survey of tribological studies of amorphous alloys and related materials (excluding quasicrystals), in roughly chronological order

| | | Test details | | | | |
|---|---|---|---|---|---|---|
| Material | Vickers hardness, HV | Test geometry sample form | Test type*; counterface or abrasive material | Load, N | Sliding speed, $ms^{-1}$ | Assessment |
| $Pd_{78.1}Si_{16.4}Cu_{5.5}$ | . . . | Pin-on-abrasion; paper; amorphous and devitrified bulk glass | A; SiC | 0.25 | 0.07-0.09 | Mass loss |
| $Ni_{40}Fe_{40}P_{14}B_6$<br>$Ni_{36}Fe_{32}Cr_{14}P_{12}B_6$<br>$Ni_{49}Fe_{29}P_{14}B_6Si_2$<br>$Fe_{80}B_{20}$; $Fe_{80}P_{16}C_3B_1$ | . . . | Ball-on-plate; ribbon | S; self-mated | . . . | . . . | None |
| $Fe_{40}Ni_{40}P_{14}B_6$<br>$Fe_{40}Ni_{38}Mo_4B_{18}$<br>$Fe_{78}Mo_2B_{20}$ | 780-1630 | Pin-on-abrasive paper; as quenched and annealed ribbons, fully amorphous to fully crystaline | A; flint or SiC | . . . | . . . | Mass loss, analysis of debris |
| $(Fe—Co—Ni)_{78}Si_{10}B_{12}$<br>Ti—(Co—Cu—Ni—Pt—Si) | . . . | Cylinder-on-flat; ribbons and foils | S; alloy steel or WC—Co | 1.5-7.5 | 0.136 | Mass loss, analysis of debris |
| Co—Nb—B<br>$Fe_{2.5}Co_{71.5}Mn_3Si_8B_{14}$<br>$Fe_{80}P_{13}C_7$; $Fe_{40}Ni_{40}P_{14}B_6$ | . . . | Magnetic tape player; magnetic head | A; $CrO_2$ tape | . . . | 5.6 | Wear depth |

TABLE 1-continued

Survey of tribological studies of amorphous alloys and related materials (excluding quasicrystals), in rough chronological order Table 1 Survey of tribological studies of amorphous alloys and related materials (excluding quasicrystals), in roughly chronological order

| | | | | | | |
|---|---|---|---|---|---|---|
| $Co_{66}Fe_4Mo_2Si_{16}B_{12}$<br>$Fe_{81}Si_4B_{15}$ | . . . | Fretting (60 μm oscillation); ribbons | F: steel | (5-20 MPa) | 0.003 | Mass loss |
| $Fe_{40}Ni_{40}P_{14}B_6$<br>(Metglas 2826) | 780-1200 | Cylinder-on-plate; compacted powdered ribbon | S: steel | 1.3-5.4 | 12-57 | Wear volume by dimension of scar |
| $Fe_{40}Ni_{40}B_{20}$ | 1000 | Cylinder-on-flat; ribbons | S; self-mated | 2.5 | 0.05 | Mass loss analysis of debris |
| $Fe_{40}Ni_{40}B_{20}$<br>$Fe_{40}Ni_{40}P_{14}B_6$<br>$Fe_{40}Ni_{38}Mo_{14}B_8$ | 1197 | Spindle-in-tube; ribbons | S; self-mated | 6.6-7.1 | 0.008-6.45 | Observation |
| $Fe_{81}B_{13.5}Si_{3.5}C_2$ | . . . | Conforming block-on-cylinder; ribbons | S; WC coated cylinder | 100-1000 | 0.025-1 | Mass loss, analysis of debris |
| $(W_{0.6}Re_{0.4})_{76}B_{24}$ | 2400 | Pin-on-disc; both sputter-coated | S; self-mated | ≤9 | 0.3 | Wear volume |
| $Fe_{67}Co_{18}B_{14}Si_1$<br>$Fe_{81}B_{13.5}Si_{3.5}C_2$<br>$Fe_{40}Ni_{38}Mo_4B_{18}$ | 1020-1071 | Reciprocating boil-on-flat, high temp., controlled atmosphere; ribbon | S; sapphire sphere | 0.2-2.5 | 0.5-15 × $10^{-4}$ | Wear volume, analysis of debris |
| $Fe_{4.7}Co_{70.3}Si_{15}B_{10}$ | 918 | Magnetic tape player; laminated ribbon | A; magnetic tapes | 0.2 | 0.1 | Wear depth |
| Ni—Mo—Cr—B | 1130-1530 | Block-and-ring or abrasive on rubber wheel; plasma sprayed, substantially amorphorus coatings | A; silica | 1335 | . . . | Wear volume |
| $Fe_{81}B_{13.5}Si_{3.5}C_2$<br>$Ni_{77.5}Si_{7.5}B_{15}$<br>$Ni_{80}Si_{10}B_{10}$ | . . .<br>890-1150 | Pin-on-disc; ribbon Pin-on-abrasive paper, sliding on flat and on wheel; ribbons, annealed, fully amorphous to fully crystalline | S; alloy steel A, S: SiC paper, steel; | 2.5-50<br>2.94 | 1-4.5<br>0.16-1 | SEM and TEM<br>Wear volume |
| (Fe, Ni, Co)—Si—B | 830-1140 | Pin-on-plate; ribbons | S: tool steel | 1.5 | 0.025 | Wear volume by dimension of scar, analysis of debris |
| $Fe_{40}Ni_{40}P_{14}B_6$ | . . . | Reciprocating tribometer; ribbons | S; self-mated | 2-12 | 0.001 | Mass loss |
| FeBSi; NiBSi + others<br>CoCrFeNiWBSiC | 785-1080 | Reciprocating crossed cylinder; foils | S; self-mated | 10 | 0.11 | Wear volume by dimension of scar |
| NiB coatings on annealed Fe | 770 | Pin-on-disc; coating | S; C6 steel | 1-12.5 | 0.001-0.033 | Three-dimensional surface roughness |
| $Fe_{58}Cr_{16}Mo_8C_{18}$<br>$Fe_{54}Cr_{16}Mo_8C_{18}Si_4$ | 965-1130 | Edge-on-wheel; consolidated powder, devitrified | S; cast iron | 9.8 | 1.0 | Scar width |
| $Fe_{81}B_{13.5}Si_{3.5}C_2$<br>$Fe_{67}Co_{18}B_{14}Si_1$<br>$Ni_{78}Si_8B_{14}$ | . . . | Pin-on-disc; ribbons | S; alloy steel | 10-25 | 0.5-4 | SEM and TEM analysis of debris |
| $Fe_{78}Mo_2B_{20}$<br>$Fe_{40}Ni_{40}P_{14}B_6$<br>Fe/Ni based<br>$Co_{58}Ni_{10}Fe_5Si_{11}B_{16}$<br>$Fe_{40}Ni_{40}B_{20}$<br>$Fe_{39}Ni_{39}Mo_2Si_{12}B_8$ | 750-1100 | Pin-on-cylinder abrasion | A; . . . | 2.8 | 0.05 | Mass loss |
| $(Fe—Co—Ru—Cr)_{75}(Si—B)_{25}$ | . . . | Magnetic tape player; laminated ribbon | A; magnetic tapes | . . . | 0.05 | Wear depth |

TABLE 1-continued

Survey of tribological studies of amorphous alloys and related materials (excluding quasicrystals), in rough chronological order Table 1 Survey of tribological studies of amorphous alloys and related materials (excluding quasicrystals), in roughly chronological order

| | | | | | | |
|---|---|---|---|---|---|---|
| $Co_{80}B_{20}$ | 1100-1500 | Scratch test; ribbons | SC; diamond stylus | 0.98-4.91 | . . . | . . . |
| $Al_{85}Y_{10}Ni_5$<br>$Al_{87.5}Ni_8Mn_{4.5}$<br>$Al_{88.5}Ni_8Mn_{3.5}$<br>$Al_{73}Si_{25}Cu_2$ | 260-305 | Pin-on-disk, 8 mm pin; consolidated powder, fully crystalline (Mm = mischmetal) | S; plain C steel (S45C) | 98 | 400 rev $min^{-1}$ | Mass loss |
| $Ni_{78}Si_{10}B_{12}$ laminated with Cu | 910 | Block-on-ring diffusion bonded laminates | S; bearing steel | 80 | 0.1 | Wear volume, analysis of debris |
| $Fe_{78}B_{13}Si_9$ | . . . | Pin-on-disc; ribbon and compacted block | S; Cr plate, or self-mated | 9.8 | 0.05-0.5 | . . . |
| $Co_{66}Ni_2Fe_4Si_{10}B_{16}V_2$<br>$Co_{39}Ni_{31}Fe_8Si_6B_{16}$ | 650-1190 | Ribbon-on-ring; ribbons, as quenched and annealed | S; low-alloy steel | . . . | 0.25-2.1 | Mass loss, analysis of debris |
| $Fe_{68}Cr_{18}Mo_2B_{12}$ | 600-1600 | Crossed cylinder; ribbons | S; WC—Co | 2-22.3 | 0.4 | Wear scar dimension |
| $Ni_{50}Ti_{50}$ | 220-550 | Ball-on-flat; partial amorphisation by shot peering or ion implantation | S; WC ball | 1.8 | . . . | . . . |
| Co—Cr—(W or Mo)—B | . . . | Abrasive; electron beam surface cladding crystalline from amorphorus feed | A; SiC | . . . | . . . | Mass loss |
| $Al_{84-88}Y_{2-8}Ni_{4-15}$ | 300-550 | Microscale abrasion; annealed ribbon, fully or partially amorphous | A; SiC | 0.25 | 0.05 | Wear volume by dimension of scar |
| $Ta_{100-x}Cr_x$(x = 28-66%) | 1630 | Microscale abrasion; sputtered thin flims | A; SiC | 0.25 | 0.05 | Wear volume by dimension of scar |
| $Al_{88}Sm_{2-10}Ni_{2-10}$ | 280-370 | Microscale abrasion; ribbons, annealed, fully or partially amorphous | A; SiC | 0.25 | 0.05 | Wear volume by dimension of scar |
| $Zr_{41}Ti_{14}Cu_{12.5}Ni_{10}Be_{14.6}$ | 527-673 | Pin-on-disc; bulk glass, annealed, fully amorphous to fully crystallised | S; alloy steel, or self-mated | 1.0-11.8 | 0.05 | Mass loss |
| $Zr_{52.5}Al_{10}Ti_5Cu_{17.9}Ni_{14.6}$ | 630-877 | Multiple nanoscratch; bulk glass, annealed, amorphous to fully creastallised | SC; Berkovich diamond indenter | 0.02 | $10^{-6}$ | Postscan depth |
| $La_{60}Al_{20}Ni_{10}Co_5Cu_5$ | 235 | Microscale abrasion; bulk glasses | A; SiC | 0.25 | 0.05 | Wear volumn |
| $Mg_{65}Ni_{20}Nd_{15}$<br>$Pd_{40}Ni_{10}Cu_{30}P_{20}$<br>$Zr_{55}Al_{10}Ni_5Cu_{30}$ | 305<br>570<br>550 | | | | | by dimension of scar |
| Al—Ni—Cu—Mn—Ti—Zr—Mg (Gigas) | 187-216 | Microscale abrasion; consolidated powder, devitrified | A; SiC | 0.25 | 0.05 | Wear volume by dimension of scar |

| Material | Wear coefficient† K | Friction coefficient | Ref(s). |
|---|---|---|---|
| $Pd_{78.1}Si_{16.4}Cu_{5.5}$ | . . . | . . . | 83 |
| $Ni_{40}Fe_{40}P_{14}B_6$<br>$Ni_{36}Fe_{32}Cr_{14}P_{12}B_6$<br>$Ni_{49}Fe_{29}P_{14}B_6Si_2$ | . . . | 0.015-0.017 | 84 |
| $Fe_{80}B_{20}$; $Fe_{80}P_{16}C_3B_1$<br>$Fe_{40}Ni_{40}P_{14}B_6$<br>$Fe_{40}Ni_{38}Mo_4B_{18}$ | 0.7-2.9 × $10^{-5}$ | . . . | 85, 86 |
| $(Fe—Co—Ni)_{78}Si_{10}B_{12}$<br>Ti—(Co—Cu—Ni—Pt—Si) | 1.5-67 × $10^{-5}$ | 0.5-1.0 | 87-89 |
| Co—Nb—B<br>$Fe_{2.5}Co_{71.5}Mn_3Si_8B_{14}$<br>$Fe_{80}P_{13}C_7$; $Fe_{40}Ni_{40}P_{14}B_6$ | . . . | . . . | 90 |
| $Co_{66}Fe_4Mo_2Si_{16}B_{12}$<br>$Fe_{81}Si_4B_{15}$ | . . . | 0.2-1.1 | 78 |
| $Fe_{40}Ni_{40}P_{14}B_6$<br>(Metglas 2826) | 1.4-17.0 × $10^{-6}$ | . . . | 25 |

TABLE 1-continued

Survey of tribological studies of amorphous alloys and related materials (excluding quasicrystals), in rough chronological order Table 1 Survey of tribological studies of amorphous alloys and related materials (excluding quasicrystals), in roughly chronological order

| | | | |
|---|---|---|---|
| $Fe_{40}Ni_{40}B_{20}$ | $0.3 \times 10^{-5}$ | 0.4-0.9 | 91-93 |
| $Fe_{40}Ni_{40}B_{20}$ | . . . | 0.15-0.6 | 94 |
| $Fe_{40}Ni_{40}P_{14}B_6$ | | | |
| $Fe_{40}Ni_{38}Mo_{14}B_8$ | | | |
| $Fe_{81}B_{13.5}Si_{3.5}C_2$ | $7 \times 10^{-5}$-$4 \times 10^{-2}$ | . . . | 95 |
| $(W_{0.6}Re_{0.4})_{76}B_{24}$ | $8 \times 10^{-8}$ | . . . | 43 |
| $Fe_{67}Co_{18}B_{14}Si_1$ | $5 \times 10^{-5}$ | 0.08-0.2 | 72, 96 |
| $Fe_{81}B_{13.5}Si_{3.5}C_2$ | 2.7-27.4 × $10^{-5}$ | 0.6-1.1 | 75 |
| Ni—Mo—Cr—B | . . . | . . . | 34 |
| $Fe_{81}B_{13.5}Si_{3.5}C_2$ | . . . | 0.2-2.2 | 97 |
| $Ni_{77.5}Si_{7.5}B_{15}$ | $2 \times 10^{-6}$ | 0.4-0.75 | 74 |
| $Ni_{80}Si_{10}B_{10}$ | | | |
| (Fe, Ni, Co)—Si—B | . . . | 0.25-1.0 | 98 |
| $Fe_{40}Ni_{40}P_{14}B_6$ | . . . | 0.2-0.8 | 99 |
| FeBSi; NiBSi + others | 0.31-33.3 × $10^{-5}$ | 0.37-0.91 | 100 |
| CoCrFeNiWBSiC | | | |
| NiB coatings on annealed Fe | . . . | 0.6-1 | 101 |
| $Fe_{58}Cr_{16}Mo_8C_{18}$ | . . . | . . . | 32, 33 |
| $Fe_{54}Cr_{16}Mo_8C_{18}Si_4$ | | | |
| $Fe_{81}B_{13.5}Si_{3.5}C_2$ | . . . | 0.2-1.2 | 102 |
| $Fe_{67}Co_{18}B_{14}Si_1$ | | | |
| $Ni_{78}Si_8B_{14}$ | | | |
| $Fe_{78}Mo_2B_{20}$ | . . . | . . . | 103 |
| $Fe_{40}Ni_{40}P_{14}B_6$ | | | |
| Fe/Ni based | | | |
| $Co_{58}Ni_{10}Fe_5Si_{11}B_{16}$ | | | |
| $Fe_{40}Ni_{40}B_{20}$ | | | |
| $Fe_{39}Ni_{39}Mo_2Si_{12}B_8$ | | | |
| $(Fe—Co—Ru—Cr)_{75}(Si—B)_{25}$ | . . . | . . . | 75 |
| $Co_{80}B_{20}$ | . . . | 0.1-0.6 | 104 |
| $Al_{85}Y_{10}Ni_5$ | 0.8-1.0 × $10^{-4}$ | . . . | 105, 106 |
| $Al_{87.5}Ni_8Mn_{4.5}$ | | | |
| $Al_{88.5}Ni_8Mn_{3.5}$ | | | |
| $Al_{73}Si_{25}Cu_2$ | | | |
| $Ni_{78}Si_{10}B_{12}$ laminated with Cu | 3.6-8.1 × $10^{-5}$ | . . . | 36 |
| $Fe_{78}B_{13}Si_9$ | . . . | 0.04-0.15 | 27 |
| $Co_{66}Ni_2Fe_4Si_{10}B_{16}V_2$ | 1-30 × $10^{-5}$ | . . . | 107 |
| $Co_{39}Ni_{31}Fe_8Si_6B_{16}$ | | | |
| $Fe_{68}Cr_{18}Mo_2B_{12}$ | 0.5-2.6 × $10^{-6}$ | . . . | 30 |
| $Ni_{50}Ti_{50}$ | . . . | 0.16-0.72 | 50 |
| Co—Cr—(W or Mo)—B | . . . | . . . | 40 |
| $Al_{84-88}Y_{2-8}Ni_{4-15}$ | 14.0-14.7 × $10^{-3}$ | . . . | 108 |
| $Ta_{100-x}Cr_x$(x = 28-66%) | 32 × $10^{-3}$ | . . . | 44 |
| $Al_{88}Sm_{2-10}Ni_{2-10}$ | 14.9-17.0 × $10^{-3}$ | . . . | 109 |
| $Zr_{41}Ti_{14}Cu_{12.5}Ni_{10}Be_{14.6}$ | 9 × $10^{-4}$ | 0.4-0.9 | 110 |
| $Zr_{52.5}Al_{10}Ti_5Cu_{17.9}Ni_{14.6}$ | . . . | 0.15-0.42 | 111 |
| $La_{60}Al_{20}Ni_{10}Co_5Cu_5$ | 11.9 × $10^{-3}$ | . . . | 112, 113 |
| $Mg_{65}Ni_{20}Nd_{15}$ | | | |
| $Pd_{40}Ni_{10}Cu_{30}P_{20}$ | 8.4 × $10^{-3}$ | | |
| $Zr_{55}Al_{10}Ni_5Cu_{30}$ | 10.9 × $10^{-3}$ | | |
| | 9.5 × $10^{-3}$ | | |
| Al—Ni—Cu—Mn—Ti—Zr—Mg (Gigas) | 7.70-8.65 × $10^{-3}$ | . . . | 31 |

*A: abrasive wear;

F: fretting;

S: sliding wear

SC: scratch test

†In the original publications, wear rates are quoted in various ways. Wear coefficient values are given here only when it has been possible to quote them in the dimensionless form K as defined in equation (1).

Further, application of coatings on surfaces and substances to lower friction encountered there-upon may be particularly desirable in manufacturing applications, where a reduction in friction likely will yield a corresponding reduction in wear over time and thus may also enhance overall process through-put and efficiency. For example, in applications concerning the oil and gas industry, piping may now be implemented in challenging geologic conditions and/or terrain, requiring abrupt turns, bends, and directional changes which, in turn, contribute to high friction conditions at those directional change points. Continued fluid flow through such high-friction areas over time may contribute to enhanced or expedited deterioration at the high-friction areas, potentially shortening overall pipe usage lifespan as well. The application of amorphous metallic materials have been shown to have a low friction coefficient relative to other non-amorphous materials, e.g. 0.17 to 0.7. [Source: WO Patent 2015168481A1]. Further development in the area of amorphous metals to achieve frictional coefficients beneath that currently achievable may provide additional enhancement in pipe coating applications.

Accordingly, it would be desirable to develop an amorphous alloy having a composition suitable for the reduction of friction for surfaces applied thereupon not otherwise achievable by conventional, non-amorphous, coatings, where the deposited amorphous alloy is truly amorphous from the moment of deposition, to both decrease friction coefficient and increase wear resistance.

SUMMARY

Presently disclosed embodiments relate to substantially metallic materials that are at least partially amorphous from the moment of deposition, such materials being beneficial for coating surfaces that may be damaged due friction caused by fluid and/or liquid flowing there-upon, such as bent regions in piping implemented in the oil and gas industry. These materials specifically have a friction coefficient of 0.05 to 0.1 and as a result can be compared favorably to other industry standard materials used as low-friction coatings that have higher friction coefficients than a range stated above.

Metal coatings discussed herein are at least partially amorphous and form stabilizing microstructural alloys on and/or with a surface to which they are applied. The amorphous metal alloy coating materials discussed here include iron- and nickel-based coatings, containing Cr, C, B, Mo, etc. in specific, pre-determined ratios and/or quantities. The coatings have a coefficient of friction ranging from 0.05 to 0.2 and can be compared favorably to other iron- and nickel-based amorphous metal alloys currently being used as low-friction coatings in, for example (but not limitation thereto), comparable industrial applications. An example embodiment discloses an amorphous metallic coating comprising: iron, chromium, a component selected from a group consisting of: boron, carbon, and combinations thereof, and two components selected from a group consisting of: molybdenum, copper, cobalt, aluminum, titanium, tungsten, niobium, silicon, vanadium, and combinations thereof.

Embodiments relate to a method for producing a metallic alloy specimen involves re-solidifying molten amorphous feedstock to eliminate formation of a crystalline structure therein by controlling a heating source and a cooling rate without affecting previously deposited amorphous layers.

In an embodiment, any one or more of the disclosed at least partially amorphous alloys deposited in accordance with disclosed process steps are fully amorphous from time zero (e.g., the time of deposition on the desired bending pipeline surface) and have a low friction coefficient (e.g., 0.05 to 0.1).

An embodiment relates to a composition comprising an amorphous alloy having a coefficient of friction (COF) of 0.15 or less, wherein the amorphous alloy is substantially free of phosphor (P) and substantially free of boron (B).

In an embodiment, the amorphous alloy contains less than 10 at. % of P and less than 10 at. % of B.

In an embodiment, the amorphous alloy contains less than lat. % of P.

In an embodiment, the amorphous alloy contains no P.

In an embodiment, the amorphous alloy comprises Fe, Cr, X, Y and Z, wherein: X, Y and Z are elements, and the Y is selected from the group consisting of boron, carbon and combinations thereof.

In an embodiment, the X and the Z are selected from the group consisting of molybdenum, copper, cobalt, aluminum, titanium, tungsten, niobium, silicon, vanadium, and combinations thereof.

In an embodiment, the amorphous alloy comprises $Fe_{100-(a+b+c+d)}(Cr_aX_bY_cZ_d)$, wherein: a is in a range of 10 to 50 at. %; b is in a range of 10 to 30 at. %; c is in a range of 2 to 10 at. %; and d is in a range of 0.5 to 10 at. %.

In an embodiment, the amorphous alloy comprises Ni, Cr, X, Y and Z, wherein: X, Y and Z are elements, and the Z is selected from the group consisting of boron, carbon and combinations thereof.

In an embodiment, the X and the Y are selected from the group consisting of molybdenum, copper, cobalt, aluminum, titanium, tungsten, niobium, silicon, vanadium, and combinations thereof.

In an embodiment, the amorphous alloy comprises $N_{100-(a+b+c+d)}(Cr_aX_bY_cZ_d)$, wherein: a is in a range of 10 to 50 at. %; b is in a range of 10 to 30 at. %; c is in a range of 2 to 10 at. %; and d is in a range of 0.5 to 10 at. %.

An embodiment relates to a method comprising solidifying a molten layer of an amorphous feedstock on a preexisting layer by controlling a heating source and a cooling rate so as to avoid formation of crystals in the molten layer and not affect a crystalline structure of the preexisting layer, and forming a specimen; wherein, the specimen comprises an amorphous alloy having a coefficient of friction (COF) of 0.15 or less.

In an embodiment, the method further comprises thermal spraying the amorphous feedstock on the preexisting layer.

In an embodiment, the thermal spraying comprises high velocity oxygen fuel spraying, plasma spraying or arc spraying.

In an embodiment, the cooling rate is 100° C./s or slower and wherein the amorphous alloy is substantially free of phosphor (P) and substantially free of boron (B)

In an embodiment, the method further comprises phase-transforming an outermost layer of the specimen such that the outermost layer comprises the amorphous alloy.

In an embodiment, the specimen comprises a partially crystalline layer beneath the outermost layer.

An embodiment relates to a method comprising obtaining a drill string, driving the drill string into a ground, and drilling a well in the ground; wherein the drill string comprises a drilling bit and a drill pipe connected thereto, wherein at least a portion of the drill pipe comprises a coating thereon, the coating comprising an amorphous alloy having a coefficient of friction (COF) of 0.15 or less, wherein the amorphous alloy is substantially free of phosphor (P) and substantially free of boron (B).

In an embodiment, the well is not straight, the well has a section that is substantially horizontal or the well has a section that is not horizontal.

An embodiment relates to a system comprising a drill string, wherein the drill string comprises a drilling bit and a drill pipe connected thereto, wherein at least a portion of the drill pipe comprises a coating thereon, the coating comprising an amorphous alloy having a coefficient of friction (COF) of 0.15 or less, and wherein the amorphous alloy is substantially free of phosphor (P) and substantially free of boron (B).

Other contemplated embodiments may include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE FIGURES

These and other features and advantages of the present invention will be better understood by reference to the following detailed description when considered in conjunction with the accompanying drawings wherein.

DETAILED DESCRIPTION OF SOME EMBODIMENTS

Definitions and General Techniques

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties, e.g., physical properties, then their crystalline counterparts. However, if the cooling rate is not sufficiently high, crystals may form inside the alloy during cooling, so that the unique benefits of the amorphous state can be lost. For example, one challenge with the fabrication of bulk amorphous alloy parts is the partial crystallization of parts due to either slow cooling or impurities prevalent in the raw alloy material. As a high degree of amorphicity (and, conversely, a low degree of crystallinity) is desirable in BMG parts, there is a need to develop methods for casting BMG parts having predictable and controlled amount of amorphicity.

Figure 1:
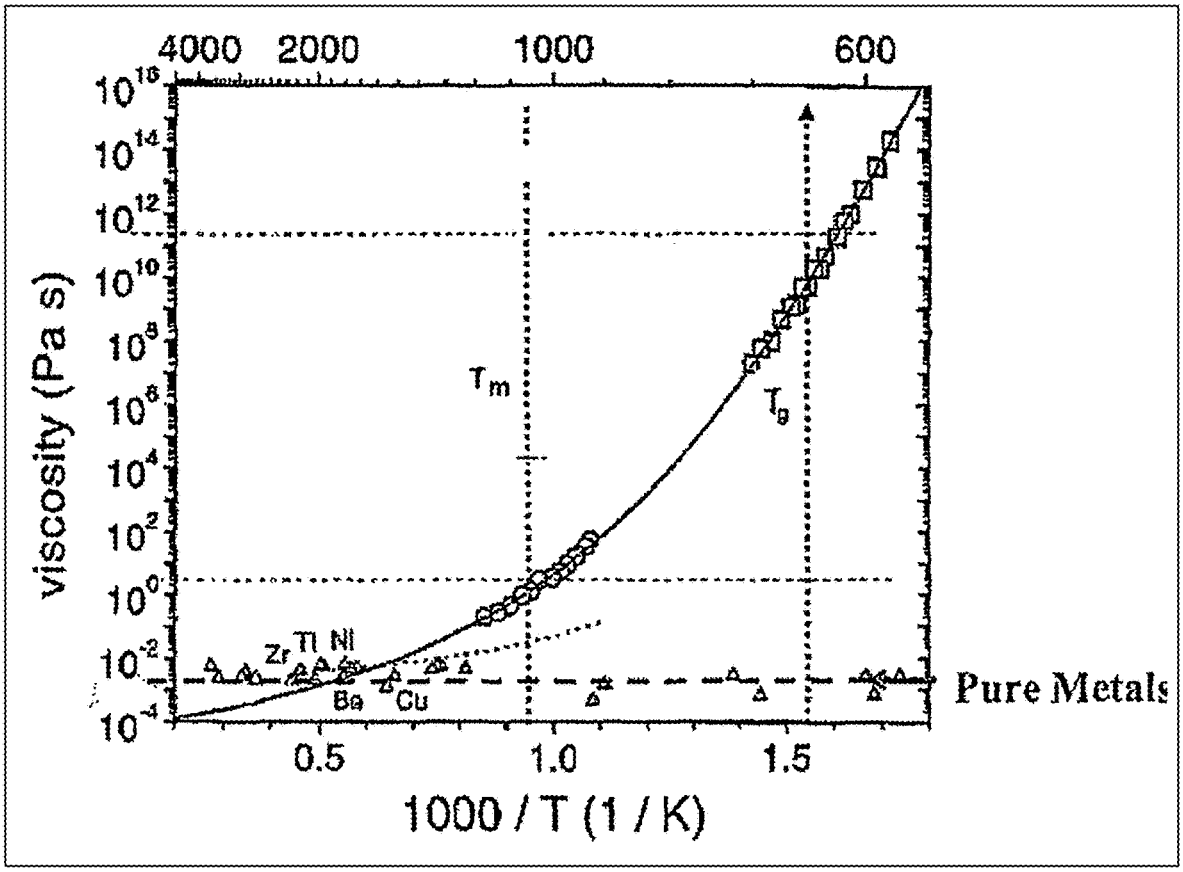
FIG. 1 PRIOR ART
FIG. 1 illustrates a viscosity-temperature graph of a bulk solidifying amorphous alloy from the VIT-001 series of Zr—Ti—Ni—Cu—Be family.

FIG. 1 (obtained from U.S. Pat. No. 7,575,040) shows a viscosity-temperature graph of a bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
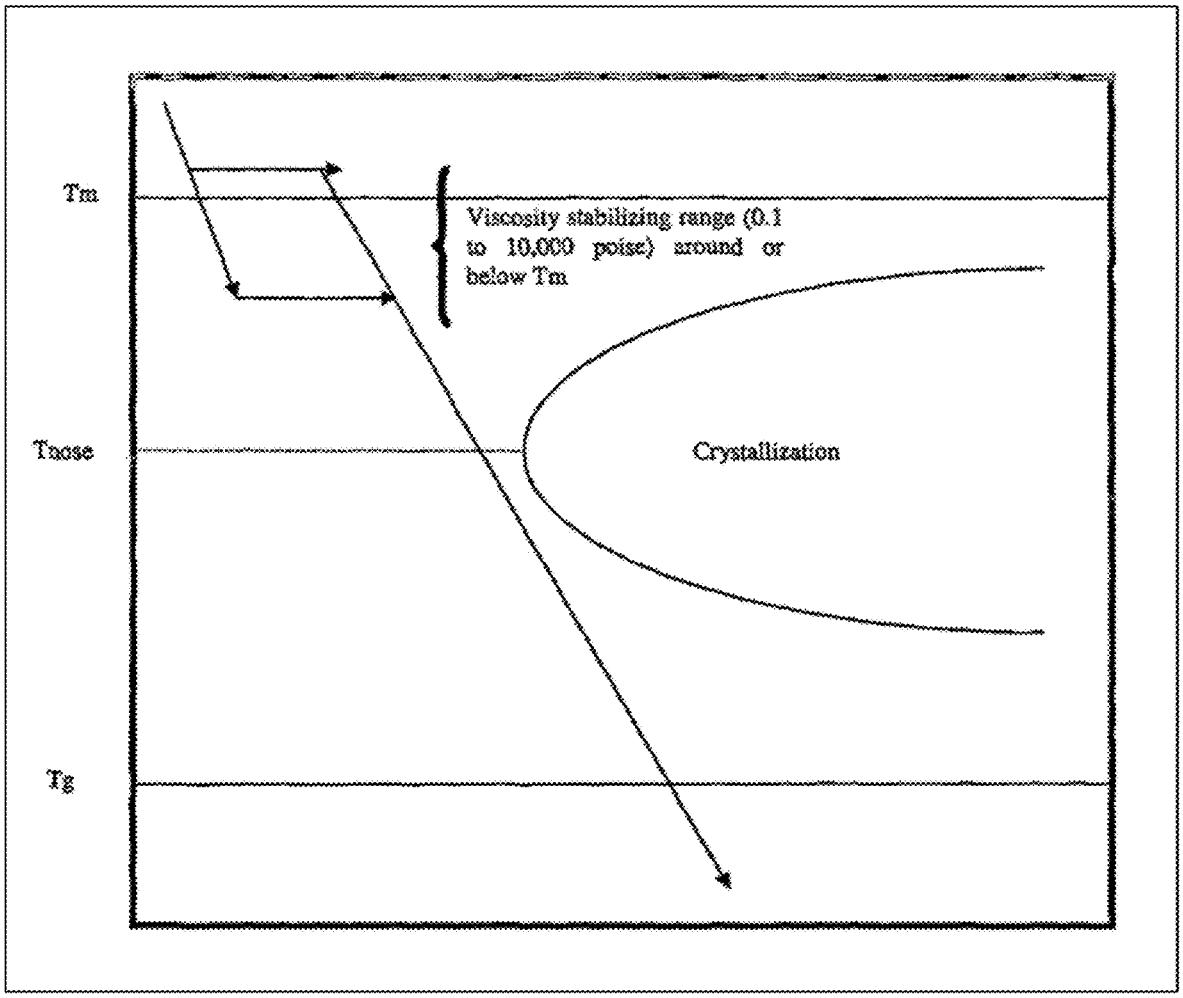
FIG. 2 PRIOR ART
FIG. 2 illustrates a time-temperature-transformation (TTT) cooling curve 200 of a bulk solidifying amorphous alloy.

FIG. 2 (obtained from U.S. Pat. No. 7,575,040) shows a time-temperature-transformation (TTT) cooling curve 200 of a bulk solidifying amorphous alloy, or TTT diagram. Bulk-solidifying amorphous metals do not experience a liquid/solid crystallization transformation upon cooling, as with conventional metals. Instead, the highly fluid, non-crystalline form of the metal found at high temperatures (near a "melting temperature" $T_m$) becomes more viscous as the temperature is reduced (near to the glass transition temperature $T_g$), eventually taking on the outward physical properties of a conventional solid.

Even though there is no liquid/crystallization transformation for a bulk solidifying amorphous metal, a "melting temperature" $T_m$ may be defined as the thermodynamic liquidus temperature of the corresponding crystalline phase. Under this regime, the viscosity of bulk-solidifying amorphous alloys at the melting temperature could lie in a range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to be such that the time-temperature profile during cooling does not traverse through the nose-shaped region bounding the crystallized region in the TTT diagram of FIG. 2. In FIG. 2, $T_{nose}$ is the critical crystallization temperature $T_x$ where crystallization is most rapid and occurs in the shortest time scale.

The supercooled liquid region, the temperature region between $T_g$ and $T_x$ is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between 1012 Pa sat the glass transition temperature down to 105 Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about $T_x$. Technically, the nose-shaped curve shown in the TTT diagram describes $T_x$ as a function of temperature and time. Thus, regardless of the trajectory that one takes while heating or cooling a metal alloy, when one hits the TTT curve, one has reached $T_x$. In FIG. 2, $T_x$ is shown as a dashed line as $T_x$ can vary from close to $T_m$ to close to $T_g$.

The schematic TTT diagram of FIG. 2 shows processing methods of die casting from at or above $T_m$ to below $T_g$ without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below $T_g$ to below $T_m$ without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above $T_{nose}$ or below $T_{nose}$, up to about $T_m$. If one heats up a piece of amorphous alloy but manages to avoid hitting the TTT curve, you have heated "between $T_g$ and $T_m$", but one would have not reached $T_x$.

Typical differential scanning calorimeter (DSC) heating curves of bulk-solidifying amorphous alloys taken at a heating rate of 20 C/min describe, for the most part, a particular trajectory across the TTT data where one would likely see a $T_g$ at a certain temperature, a $T_x$ when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no $T_x$ upon heating. Another way to think about it is trajectories (2), (3) and (4) can fall anywhere in temperature between the nose of the TTT curve (and even above it) and the $T_g$ line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function:

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloyIGs of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as VITRELOY™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt. %, such as at least about 40 wt. %, such as at least about 50 wt %, such as at least about 60 wt. %, such as at least about 80 wt. %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in a range of from 30 to 75, b is in a range of from 5 to 60, and c is in a range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in a range of from 40 to 75, b is in a range of from 5 to 50, and c is in a range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in a range of from 45 to 65, b is in a range of from 7.5 to 35, and c is in a range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in a range of from 45 to 65, b is in a range of from 0 to 10, c is in a range of from 20 to 40 and d is in a range of from 7.5 to 15 in atomic percentages. One embodiment of the described alloy system is a Zr—Ti—Ni—Cu—Be based amorphous alloy under the trade name VITRELOY™, such as Vitreloy-1 and Vitreloy-101, as fabricated by Liquidmetal Technologies, CA, USA. Some examples of amorphous alloys of the different systems are provided in Table 2 and Table 3.

TABLE 2

| Amorphous Alloy Compositions | | | | | | | | |
|---|---|---|---|---|---|---|---|---|
| Alloy | At. % | At. % | At. % | At. % | At. % | At. % | At. % | At. % |
| 1 | Fe 68.00% | Mo 5.00% | Ni 5.00% | Cr 2.00% | P 12.50% | C 5.00% | B 2.50% | |
| 2 | Fe 68.00% | Mo 5.00% | Ni 5.00% | Cr 2.00% | P 11.00% | C 5.00% | B 2.50% | Si 1.50% |
| 3 | Pd 44.48% | Cu 32.35% | Co 4.05% | P 19.11% | | | | |
| 4 | Pd 77.50% | Ag 6.00% | Si 9.00% | P 7.50% | | | | |
| 5 | Pd 79.00% | Ag 3.50% | Si 9.50% | P 6.00% | Ge 2.00% | | | |
| 5 | Pt 74.70% | Cu 1.50% | Ag 0.30% | P 18.0% | B 4.00% | Si 1.50% | | |

TABLE 3

| Additional Amorphous Alloy Compositions (Atomic %) | | | | | | |
|---|---|---|---|---|---|---|
| Alloy | At. % | At. % | At. % | At. % | At. % | At. % |
| 1 | Zr 41.20% | Ti 13.80% | Cu 12.50% | Ni 10.00% | Be 22.50% | |
| 2 | Zr 44.00% | Ti 11.00% | Cu 10.00% | Ni 10.00% | Be 25.00% | |
| 3 | Zr 56.25% | Ti 11.25% | Cu 6.88% | Ni 5.63% | Nb 7.50% | Be 12.50% |
| 4 | Zr 64.75% | Ti 5.60% | Cu 14.90% | Ni 11.15% | Al 2.60% | Be 1.00% |

TABLE 3-continued

| Additional Amorphous Alloy Compositions (Atomic %) | | | | | | |
|---|---|---|---|---|---|---|
| Alloy | At. % | At. % | At. % | At. % | At. % | At. % |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in a range of from 5 to 25 atomic percentage, and the total of (C, Si, B, P, Al) is in a range of from 8 to 20 atomic percentage, as well as the composition $Fe_{48}Cr_{15}Mo_{14}Y_2C_{15}B_6$. They also include the alloy systems described by Fe—Cr—Mo—(Y, Ln)-C—B, Co—Cr—Mo-Ln-C—B, Fe—Mn—Cr—Mo—(Y, Ln)-C—B, (Fe, Cr, Co)—(Mo, Mn)—(C,B)—Y, Fe—(Co, Ni)—(Zr, Nb, Ta)—(Mo, W)—B, Fe—(Al, Ga)—(P, C, B, Si, Ge), Fe—(Co, Cr, Mo, Ga, Sb)—P—B—C, (Fe, Co)—B—Si—Nb alloys, and Fe—(Cr—Mo)—(C,B)-$T_m$, where Ln denotes a lanthanide element and $T_m$ denotes a transition metal element. Furthermore, the amorphous alloy can also be one of the compositions $Fe_{80}P_{12.5}C_5B_{2.5}$, $Fe_{80}P_{11}C_5B_{2.5}Si_{1.5}$, $Fe_{74.5}Mo_{5.5}P_{12.5}C_5B_{2.5}$, $Fe_{74.5}Mo_{5.5}P_{11}C_5B_{2.5}Si_{1.5}$, $Fe_{70}Mo_5Ni_5P_{12.5}C_5B_{2.5}$, $Fe_{70}Mo_5Ni_5P_{11}C_5B_{2.5}Si_{1.5}$, $Fe_{68}Mo_5Ni_5Cr_2P_{12.5}C_5B_{2.5}$, and $Fe_{68}Mo_5Ni_5Cr_2P_{11}C_5B_{2.5}Si_{1.5}$, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and U.S. Pat. No. 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One composition is $Fe_{72}A_{15}Ga_2Pl_1C_6B_4$. Another example is $Fe_{72}A_{17}Zrl_0Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in a range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The described amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between $T_g$ and $T_x$, for example. Herein, $T_x$ and $T_g$ are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_x$. The cooling step is carried out at rates similar to the heating rates at the heating step, and preferably at rates greater than the heating rates at the heating step. The cooling step is also achieved preferably while the forming and shaping loads are still maintained.

Amorphous Alloy Manufacturing

Amorphous alloys and bulk amorphous alloys may currently be manufactured by two primary techniques: (1) solidification; and (2) consolidation. Solidification techniques encompass the following: listed arc melting, splat quench, metal injection molding, jet casting, twin-roll casting, die casting, copper mold casting, suction casting and high pressure die casting (HPDC). Consolidation techniques include: hot pressing, warm extrusion, explosive compaction and spark plasma sintering. However, the discussed techniques or processes severely limit manufacturing net-shape components relying upon amorphous metal feedstock.

There have been only a few reports on fabrication of bulk alloys using casting. This method has been used because of excellent dimensional accuracy of the finished or final product, smooth cast surfaces as-cast that eliminates or reduces post-machining operations and rapid production rates, among other advantages. Casting includes melting the amorphous alloys and melt injection thereafter into a mold. The molten amorphous alloys injected into the mold are then pressed under a relatively high pressure either mechanically or hydraulically while under a controlled atmosphere. Such conditions allow for the pushing of the molten amorphous alloys into desired mold cavities and complex recessions to produce correspondingly complex shapes with a high degree of accuracy and a fully dense structure. Such die casting as described of amorphous materials is further discussed in various U.S. Patents including U.S. Pat. Nos. 6,021,840 and 6,070,643, both of which are incorporated herein by reference in their respective entireties. In a report, an Fe-based alloy has been cast with an inner diameter of 6 mm and an outer diameter of 10 mm. A reason for the selection of such dimensions is that the Fe-based bulk amorphous alloys may be very brittle. Hence, they are only limited to manufacturing in a laboratory scale and cannot withstand a large scale or volume industrial casting process.

Another technology to manufacture Fe-based bulk metallic alloys is powder metallurgy (PM), a process that includes: pulverization, compaction and sintering. Solid state sintering includes: isostatic pressing, hot isostatic pressing (HIP), shock consolidation, electric current assisted sintering, such as spark plasma sintering, etc. However, this technology involves hot pressing and/or sintering which could deteriorate some of most important properties of the Fe-based bulk metallic alloys including: amorphic state, mechanical properties, and magnetic properties, among others.

Relatively low viscosity at the melting temperature will provide fast and complete filling of intricate portions of a shell/mold with a bulk solidifying amorphous metal for forming the amorphous metallic alloy parts. Engel Global, of Schwertberg, Austria, has developed an injection molding machine capable of processing amorphous metallic alloys. During operation, the amorphous alloy blanks are automatically fed into a melting chamber where the blanks are then melted inductively under high vacuum conditions. The molten metal alloy is injected into a thermo-regulated mold through a piston. Very rapid cooling under exclusion of oxygen leads to the forming of the amorphous structure. The process may be completed in a timeframe that is significantly shorter than PM processes while also including high surface quality as finish with minimal or no need for CNC processing. However, this process does have limitations regarding the maximum size of each part able to be fabricated, as well as regarding the specific dimensions of the parts. For instance, wall thickness of parts produced by the process may vary between 1 and 4 mm and part weight up to 80 g. (P. Hauck: Liquidmetal and Metal Injection Molding: Two complementary metal forming technologies, Powder Injection Molding International 8[3] (2014) 53-61).

High Pressure Die Casting (HPDC) is a much faster technique, compared to other casting techniques, and also offers a high dimensional accuracy and productivity. Ramasamy et al. (P. Ramasamy, A. Szabo, S. Borzel, J. Eckert, M. Stoica, A. Bardos: High pressure die casting of Fe-based metallic glass, Scientific Reports 6, 2016) studied the effect of HPDC process parameters on microstructural evolution, thermal and magnetic properties of a Fe-based amorphous alloy. They concluded that the quality of the samples is strongly influenced by die material, amorphous alloy temperature during casting and flow rate of the amorphous alloy. Even complex geometries with high dimensional accuracy could be achieved, but undesirable porosity and cracking during solidification limited this method to manufacture amorphous metallic alloy parts.

The viscosity of amorphous alloys at the melting temperature lie in a range of about 0.01 poise to about 10,000 poise, and bulk solidifying alloy can exist as a highly viscous liquid between the melting and glass transition temperature. The process-ability of amorphous alloys in the supercooled liquid region is similar to plastics with strain rates of the order of 0.01 s−1. Hence, Thermoplastic Forming (TPF) has also been used for manufacture Fe-based bulk amorphous alloys. However, a short processing time to avoid crystallization is a major disadvantage of this technology for manufacturing large and complex parts. Further, geometric constraints exist as imposed by reducing the sample size or feature below a critical length scale of 1 mm. Nevertheless, this technology offers near-net shape geometry parts, very good surface finish and the ability to manufacture fine and small complex structures.

All these traditional metal manufacturing/forming methods have proven to be unsuccessful in developing components thicker than 70 mm in case of nonferrous amorphous alloys and thicker than 6 mm in case of ferrous alloys (Table 4). In addition, all these methods were unsuccessful to produce complex geometries, and most importantly due to the cooling limitations of these methods, as it is difficult to suppress completely the phase crystallization resulting on parts that are not fully amorphous.

TABLE 4

Amorphous Alloys Systems and Maximum Part Thicknesses of their Corresponding Bulk Amorphous Alloys

| Ferrous Amorphous Alloys | Maximum Cast Thickness [mm] |
|---|---|
| Fe—(Al, Ga)—(P, C, B, Si, Ge) | 3 |
| Fe—(Nb, Mo)—(Al, Ga)—(P, B, Si) | 5 |
| Fe—(Zr, Hf, Nb)—B | 5 |
| Fe—(Co, Ni)—(Zr, Hf, Nb)—B | 6 |

TABLE 4-continued

| Amorphous Alloys Systems and Maximum Part Thicknesses of their Corresponding Bulk Amorphous Alloys | |
|---|---|
| Ferrous Amorphous Alloys | Maximum Cast Thickness [mm] |
| Fe—(Al, Ga)—(P, C, B, Si) | 3 |
| Fe—(Co, Mo)—(C, B)—Y | 16 |
| Fe—(Cr, Mo)—(C, B, P) | 2.2 |
| Co—(Al, Ga)—(P, B, Si) | 1 |
| Co—(Zr, Hf, Nb)—B | 1 |
| Ni—(Zr, Hf, Nb)—B | 1 |

While amorphous materials offer great promise for different applications, it is difficult to achieve their benefits because of the problems encountered in preparing parts based on the amorphous metallic alloys. However, such problems may be largely avoided by using amorphous alloys in coating related technologies to realize the benefits of the alloys. In such an application, the amorphous alloys are applied as a coating on a surface of a metallic part. Indeed, because of limitations in application thickness, metallic glasses were initially largely limited to applications that involved coatings. Technologies to apply such coatings include: thermal spraying techniques (plasma spraying, arc spraying, high velocity oxygen fuel and high velocity Air Fuel), Physical Vapor Deposition (PVD), electrodeposition, etc. For example, in some thermal spraying techniques, metallic glass in a powdered form of micrometer sized particles is sprayed onto the object to be coated. In other thermal spraying techniques, metallic glass in a wire form is heated to a molten state and thereby applied to the object to be coated. The thermal sprayed coatings are usually rough and require a grinding finishing step to achieve the dimensional accuracy. During thermal spraying technique, a cooling rate of $10^8$K/s could be achieved. This high cooling rate results in a low shear rate and high toughness (US20140202595A1). This combination could offer amorphous or amorphous based thermal sprayed coatings with high hardness and high toughness. During thermal spraying, feedstock in powder, wire or rod form is soften in a heat source that could be flame, arc, plasma or laser. The soften material is accelerated to high-speed and solidified as soon as deforms on the substrates to be coated and form a dense and well bonded coating.

Thinner coating could be achieved through PVD technique. However, this technique is limited insofar the part size is constrained from the PVD chamber size. In addition, as with all coatings applied as protective layers, if a thin amorphous coating is worn away in a location of the part exposed to particularly severe conditions and/or heavy friction, the parts may not be protected anymore by the thin amorphous coating. In addition, a localized coating cracking or worn out can grow in lateral extent rapidly, so that adjacent portions of the coating are undermined and the coating flakes away. There is then a very rapid increase in the rate of damage, so that failure of a part thought to be protected can occur catastrophically.

Amorphous alloys and bulk amorphous alloys may be used as a feedstock material for advanced manufacturing techniques such as additive manufacturing, an industrial production technology that has developed from advances in 3D printing regarding precision, repeatability and material range. Additive manufacturing, generally, refers to a transformative approach to traditional industrial production that enables the fabrication of parts demonstrating desirable physical properties, including improvements in strength and weight reduction when compared to parts made through conventional manufacturing.

3D printing refers to any one or more of the various processes in which material may be joined, glued, adhered, or otherwise solidified under computer control to create a 3D object, with source/feedstock material being added together (e.g., liquid molecules, or powder grains being fused together), typically in a layer-by-layer manner. Objects printed by 3D printing can now have a very complex shape or geometry and typically are produced based on a digital 3D model or a computer-aided-design (CAD) file.

Although there are several 3D printing processes, all 3D printing processes or production techniques can generally be categorized into the following seven categories: (1) vat photopolymerization; (2) material jetting; (3) binder jetting; (4) powder bed fusion; (5) material extrusion; (6) directed energy deposition; and (7) sheet lamination. Also, fused deposition modeling (FDM) has gained prominence regarding the fabrication of metal parts in the 3D printing industry. In FDM, material is added layer-by-layer, instead of conventional machining which may require material to be removed from an item, or traditional casting and forging processes.

General principles governing additive manufacturing or 3D printing may include the following: (1) modeling; (2) printing; (3) finishing; as well as: (4) multi-material printing. Regarding modeling, 3D printable models may be created with the aid of a CAD package through a 3D scanner, or by a digital camera used with photogrammetry software. Printing often involves a layer-by-layer deposition of material according to computer-aided direction, e.g., building the material in the upward vertical direction after the deposition of an initial base or foundation layer to form a completed item or part. Complex geometries and hollowed-out interior surfaces are feasible with modern methods. Finishing refers to the process of achieving greater accuracy than possible by 3D printing alone by printing a slightly oversized version of the desired object to later remove excess material using a higher-resolution subtractive process. Multi-material printing allows for objects to be composed of complex and heterogenous arrangements of source materials, and may require specific materials being directed to specific voxels, e.g., referring to each of an array of elements of volume that constitute a notional three-dimensional space, inside the object volume.

Drilling and Tunneling in the Gas and Oil Industry

Recent developments in the oil and gas industry, and other related industries such as mining and excavation, have resulted in the implementation of piping that is no longer straight, e.g., extending directly down in a direction perpendicular to the ground surface. Sophisticated drilling techniques accommodate the insertion and usage of pipeline that have multiple bends, turns, abutments and/or other directional changes. Such turns may cause increased friction for fluid and/or liquid traveling through regions of the pipeline with such directional changes as described when compared to traditional straight pipe conditions. As a result of observing decreases in operational efficiency as may be a result of reduction in fluid flow through high-friction areas, e.g., such as encountered at a directional change in a pipe, oilfield drilling engineers, operators and other qualified personnel may seek ways to reduce friction by implanting and/or applying various types of pipeline coatings and methodologies to minimize friction encountered in directional change regions within pipes.

Figure 3:
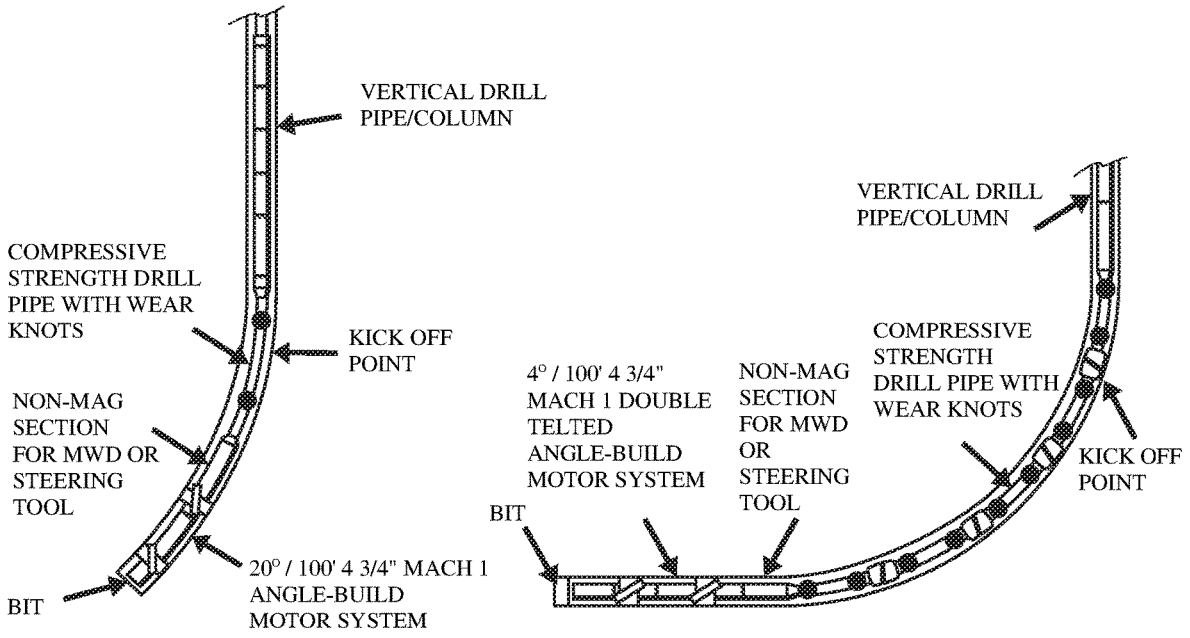
FIG. 3 illustrates cut-away side views of several example bent drilling pipes intended for use in underground drilling applications in accordance with the disclosed embodiments.

FIG. 3 [source: *Drilling and Excavation Technologies for the Future,* 1994, National Research Council] illustrates typical arrangements for substantially horizontal, e.g., relative to a flat ground surface, and directional drilling, respectively. In the example of directional drilling, the depicted pipe, instead of extending in a straight downward direction perpendicular to the surface, features a gentle curvature allowing the pipe to turn and run horizontally parallel to the surface. The curvature is noted to be 2 to 5 degrees per hundred feet, resulting in turning radii of 300 to 1000 feet. This curvature allows wells to be drilled to create a shallow exploratory core hole for prospecting purposes or a production oil well. Such directional drilling also allows wells to reach strategic locations not accessible through straight, vertical holes, such as (but not limited to) locations a substantial horizontal distance from the initial borehole drilling location, or wells that can be more productively drilled from a horizontal approach rather than a vertical approach. To produce a horizontal well, instead of drilling straight down, a rock cutting assembly may tilted at an angle relative to a well wall, with the sharpness of the turn largely determined by the angle the rock cutting assembly makes with the wall.

Should a desired target well not be entirely straight, the bending of a drill string used to form the well and/or individual drill pipes used to extract fluid, such as oil, from the well may be configured to contact one or more walls of the well. Such contact may expose the drill pipes to friction-related wear mechanisms that may significantly affect the integrity of the drill pipes, such as abrasion from contact with the underground formations, and abrasion from contact between metal parts. Possible solutions may include placing clamps on the drill pipe to retain the pipe in a position away from contacting the wall, covering the pipe in protective and/or friction-reducing rubber sleeves, or applying coatings like paint, epoxy coatings, or amorphous metal alloy coatings to reduce friction encountered on applied-to surfaces. However, these solutions alone may not be sufficient to eliminate the direct contact of the drill pipes to the well wall, or prevent abrasion of the pipe from such contact.

Terminology

The phrase "substantially free of phosphor (P)" as used herein means less than 13 atomic % (at. %) of P.

The phrase "substantially free of boron (B)" as used herein means less than 13 atomic % (at. %) of P.

EMBODIMENTS

Embodiments disclosed herein relate to the production of amorphous metal alloys comprising chromium, a component selected from the group consisting boron, carbon, and combinations thereof, two components selected from the group consisting molybdenum, copper, cobalt, aluminum, titanium, tungsten, niobium, silicon, vanadium, and combinations thereof, and the balance of nickel or iron to reduce friction on applied surfaces; specifically, compositions are disclosed to reduce friction levels beneath that otherwise achievable by conventional coatings, especially in implementations concerning bends in piping related to the oil and gas industry, or mining and excavation more generally. Such parts demonstrate better wear resistance while maintaining an amorphous structure throughout and after manufacturing. The amorphous alloy can be applied through thermal spraying, as well as plating or welding, to obtain an amorphous metal coating. The above compounds have friction coefficients ranging from 0.05 to 0.1, resulting in less friction damage and therefore superior wear resistance.

Amorphous metals are a new class of metal alloy-based materials that have a disordered, non-crystalline, and glassy structure. Amorphous metals may be created when metals or their alloys are: (1) cooled very quickly; or (2) have a unique composition that allows for the bypass of crystallization during solidification of the material. Rapid cooling of metals may be achieved upon exposure or application of metals to a supercooled liquid to reduce the temperature of the metals beneath the melting temperature $T_m$, and by exposure of the metals to an appropriate cooling rate to permit the metals in liquid phase to solidify with an amorphous structure.

The preparation of new amorphous metallic alloys that form amorphous structure below the glass transition temperature at a rate between 100 to 1,000 K/sec are described in U.S. Pat. No. 9,499,891. Earlier, glassy ingots with 5 mm diameter were produced from an alloy having a composition of 55% palladium, 22.5% lead, and 22.5% antimony, by using surface etching followed with several heating-cooling cycles. More recently, new alloys have been developed that form an amorphous structure at cooling rates as slow as 1 K/sec. These amorphous alloys can be cast into parts of up to several centimeters in thickness depending on the type of alloy used while continuing to retain an amorphous structure. Optimal glass-forming alloys may be based at least in part on zirconium and palladium, but alloys based on iron, titanium, copper, magnesium, and other metals are also known. These alloys have a high temperature difference between the glass transition temperature and the crystallization temperature. Some of the alloys have a difference between glass transition and crystallization of about less than 70 degrees, thus resulting in limitations encountered during manufacturing of these alloys.

Regardless of challenges associated with their formation, amorphous metals are often desirable in a number of applications due to their unique microstructure, which combines ultra-high strength, high hardness and ductility. They are also more corrosion resistant relative to conventional metals due to the lack of long-range periodicity, related grain boundaries and crystal defects such as dislocations down to the atomic scale. Moreover, they may be stronger than crystalline metals and can sustain larger reversible deformations than crystalline alloys. However, bulk consolidation of these amorphous powders is crucial to maintain amorphous structure.

Protective and/or friction-reducing coatings have been applied to surfaces susceptible for enhanced abrasion and/or wear for numerous years. For example, it is known that Electrolytic Hard Chrome ("EHC") coatings have excellent wear and corrosion resistance, but are limited by how thick the layers of the coating can be built up. However, thermal-spray technology, in comparison, can be layered on as thick as desired due to its material chemistry. Amorphous-based coating can be adjusted in chemistry to a variety of application specifications to meet the specific requirements, including but not limited to high wear resistance, low friction, and other specifications. Currently, manufactured amorphous alloys have friction coefficients ranging from 0.015 to 0.9 [Source: "Wear resistance of amorphous alloys and related materials"; Greer, A. L.; Rutherford, K. L.; Hutchings, I. M.; International Materials 47, 87 11]. Higher friction coefficients correspond to higher amounts of wear that can lead to deformation of the base substrate and structural weakening. The wear resistance capabilities of amorphous alloys may also at least partially depend upon the composition of the amorphous alloy. Observed friction coefficients are lowest for alloys based on late transition metals (e.g., iron, cobalt, or nickel), as opposed to early transition metals (i.e. titanium or zirconium) or refractory metals (i.e., niobium or tantalum). [Source: "Sliding friction and structural relaxation of metallic glasses"; Giessen, B. C.; Whang, S. H.; J. Met. 1981, 33(9), A66-A66]. The quality and wear resistance of manufactured amorphous alloys in terms of application are directly influenced by its friction coefficient, which in turn depends on the chemical composition of the alloy.

Depending on the application needed, e.g., coating bends in piping used for drilling for below-ground oil wells, the composition of the amorphous alloy can be selected for a lower friction coefficient and therefore better wear resistance. Underground pipes drilling for oil face challenges like physical corrosion based on friction wear, especially if they are bent and come directly into contact with the walls of the well (see FIG. 3). While possible solutions include clamping rubber sleeves on the drill pipe as insulation or using other coatings such as paints or epoxy coatings, these approaches may not be sufficient to prevent ongoing abrasion of the pipe or eliminate undesirable direct contact between the drill pipe and the wall. [Source: WO Pat. 2015168481A, "Underground components with amorphous coating", LiquidMetal Coatings, LLC]. These shortcomings can result in wear loss and/or structural damage due to high friction, weakening the pipe and reducing efficiency.

A proposed solution according to embodiments herein is to use an amorphous alloy formed during the solidification of metallic amorphous liquids. The amorphous alloy composition is iron- or nickel-based. One example family of transformable alloys for this application can be described as $Fe_{100-(a+b+c+d)}(Cr_aX_bY_cZ_d)$ wherein a, b, c, and d represent atomic percentages. "a" may be in a range of 10 to 50 at. %; "b" may be in a range of 10 to 30 at. %; "c" may be in a range of 2 to 10 at. %; and d may be in a range of 0.5 to 10 at. %. Another exemplary family of transformable alloys for this application can be described as $Ni_{100-(a+b+c+d)}(Cr_aX_bY_cZ_d)$ wherein a, b, c, and d represent atomic percentages. "a" may be in a range of 10 to 50 at. %; "b" may be in a range of 10 to 30 at. %; "c" may be in a range of 2 to 10 at. %; and d may be in a range of 0.5 to 10 at. % The Z component could be selected from the group consisting of boron, carbon, and combinations thereof. The X and Y components could be selected from the group consisting molybdenum, copper, cobalt, aluminium, titanium, tungsten, niobium, silicon, vanadium, and combinations thereof.

Further embodiment of the present invention comprise a thermal sprayed coating formed from a thermal spray powder comprising amorphous materials of the above-mentioned compositions, $Fe_{100-(a+b+c+d)}(Cr_aX_bY_cZ_d)$ or $Ni_{100-(a+b+c+d)}(Cr_aX_bY_cZ_d)$. The steps comprising: providing an amorphous or partially amorphous thermal spray and thermally spraying any of the above-mentioned powder onto the substrate. Thermal spraying is done with any conventional and any new develop thermal spraying systems, including but not limited to flame spraying, plasma spraying, detonation spraying, arc spraying, cold spraying, or high velocity oxygen fuel or any other thermal spraying technique. The deposited sheet, in an amorphous state, is then cooled using a cooling sheet to reduce crystallization, then buffed down in order to obtain an amorphous surface.

The amorphous material may be used for manufacturing. The amorphous metallic material may be deposited layer-by-layer to produce multifunctional parts with ultra-high strength, without sacrificing toughness, to show wear resistance on account of the low friction coefficient of the amorphous structure. The amorphous material may be deposited using different additive manufacturing techniques including (but not limited to) thermal spraying, plating, welding (provided the welded area is cooled quickly), and spraying partially amorphous materials and/or nano-crystalline and/or crystalline materials that may be transformed to become fully amorphous.

EMBODIMENTS

Amorphous Metals—Generally

Of the type of materials presented and discussed above regarding potential application and usage in additive manufacturing, metals, and more specifically amorphous metals, possess unique physical properties making their usage in additive manufacturing particularly desirable. Generally, an amorphous metal is a solid metallic material, often an alloy, having a disordered atomic-scale structure. While many metals are crystalline in their solid state (e.g., indicating a highly-ordered arrangements of atoms), amorphous metals are non-crystalline and have a glass-like structure. However, unlike common glasses, which are typically electrical insulators, amorphous metals have good electrical conductivity. In embodiments herein, amorphous metals may be produced by several methods, including the following: extremely rapid cooling, physical vapor deposition ("PVD"), solid-state reaction, iron irradiation, and mechanical alloying.

Earlier, small batches of amorphous metals have been produced via a variety of rapid cooling methods, including sputtering molten metal onto a spinning metal disk (referred to as "melt spinning"). The rapid cooling, on the order of millions of degrees C. per second, is too fast for crystallization to occur and the material is "locked" or "frozen" into a glassy state. Recently, alloys with critical cooling rates low enough to permit formation of amorphous structure in thicker layers (e.g., over 1 millimeter) have been made; these are referred to as bulk metallic glasses ("BMG").

Physical Properties of Amorphous Metals Used in Manufacturing

Amorphous metal is typically an alloy, rather than a pure metal (defined herein as not being joined with any other metal or synthetic metal). Alloys, defined herein as a metal made by combining two or more metallic elements (to give greater strength or resistance to corrosion) contain atoms of significantly different size that leads to reduced free volume, and thus considerably higher viscosity than other metals and alloys, in a molten state. The increased viscosity of molten amorphous metal prevents its atoms from moving around enough to create an ordered lattice. Also, the material structure of an amorphous metal also results in reduced shrinkage during cooling, and resistance to plastic deformation. The absence of grain boundaries (defined herein as the interface between two grains, or crystallites, in a polycrystalline material; grain boundaries are 2D defects in a crystal structure and tend to decrease the electrical and thermal conductivity of the material), the weak areas of crystalline materials, provides improved resistance to wear and corrosion. Also, amorphous metals, while classified as being glasses, are also considerably tougher and less brittle than oxide-based glasses and ceramics. Thermal conductivity of amorphous materials is lower than that of crystalline metal. As formation of amorphous structure relies on fast cooling, this limits the maximum achievable thickness of amorphous structures.

Alloy chemistry influences, and potentially determines, the friction coefficient and by extension the wear resistance of the resulting amorphous coating. It has been demonstrated that alloys based on late transition metals like nickel or cobalt have the smallest friction coefficient, correlating with less wear. For instance, cobalt- and nickel-based amorphous alloys have high wear resistance against dry sliding wear while showing lower friction coefficients than iron-based alloys.

In an embodiment, there is provided an amorphous alloy comprising $Fe_{100-(a+b+c+d)}(Cr_aX_bY_cZ_d)$ wherein a, b, c, and d represent atomic percentages. "a" is in a range of 10 to 50 at. %, "b" is in a range of 10 to 30 at. %, "c" is in a range of 2 to 10 at. %, and "d" is in a range of 0.5 to 10 at. %. The Y component selected from the group consisting of boron, carbon, and combinations thereof, and the X and Z components selected from the group consisting molybdenum, copper, cobalt, aluminium, titanium, tungsten, niobium, silicon, vanadium, and combinations thereof; and, re-solidifying the at least partially molten amorphous feedstock to eliminate formation of a crystalline structure therein by controlling a heating source power and cooling rate without affecting previously deposited at least partially molten amorphous feedstock layers. The heating source may be selected from the following: a laser, a plasma, an arc, and an infrared source. The feedstock may be provided in powder or wire form.

According to another embodiment, there is provided an amorphous alloy comprising $Ni_{100-(a+b+c+d)}(Cr_aX_bY_cZ_d)$ wherein a, b, c, and d represent atomic percentages. "a" is in a range of 10 to 50 at. %, "b" is in a range of 10 to 30 at. %, "c" is in a range of 2 to 10 at. %, and "d" is in a range of 0.5 to 10 at. %. The Z component selected from the group consisting of boron, carbon, and combinations thereof, and the X and Y components selected from the group consisting molybdenum, copper, cobalt, aluminum, titanium, tungsten, niobium, silicon, vanadium, and combinations thereof; and, re-solidifying the at least partially molten amorphous feedstock to eliminate formation of a crystalline structure therein by controlling a heating source power and cooling rate without affecting previously deposited at least partially molten amorphous feedstock layers. The heating source may be selected from the following: a laser, a plasma, an arc, and an infrared source. The feedstock may be provided in powder or wire form.

Advantages

Advantages of the disclosed embodiments include providing an amorphous metallic alloy composition that has a low friction coefficient, therefore making it more wear-resistant without sacrificing its amorphous qualities. The friction coefficients once the coating is applied range from 0.05 to 0.1, which is lower than the industry standard. The disclosed amorphous alloy has a lower friction coefficient because it is amorphous from the moment it is deposited, improving its wear resistance while making the surface it is applied on (e.g. a pipeline) harder. This results in a more wear-resistant surface while still being amorphous and retaining the associated qualities.

The random organization nature of amorphous metallic alloys makes them free from the typical defects associated with crystalline structures, such as dislocations and grain boundaries. This disordered, dense atomic arrangement and the absence of crystal slip systems determines the unique structural and functional properties of amorphous alloys. Thus, amorphous metals are more wear resistant compared to conventional metals due to the lack of long-range periodicity, related grain boundaries and crystal defects such as dislocations. In addition, they are stronger than crystalline metals and they can sustain larger reversible deformations than crystalline alloys. Due to their unique microstructure, amorphous metals combine ultra-high strength, high hardness and ductility in one single material.

As presented and discussed earlier, amorphous metal alloys can be tailored to fit specific needs while still retaining the benefits of their amorphous structures, including adapting the composition to result in improved friction resistance. As indicated by evaluating the disclosed compositions, the friction coefficient of the alloy can be decreased, resulting in superior wear resistance.

EXAMPLES

Example 1

Foil bearings are a technology that uses an air/gas film between the rotating shaft and top foil for lubrication and bearing stability. Foil bearings do not rely on metal to metal contact in order to operate, but air or gas acts as lubricant that separates two surfaces in relative motion. Therefore, they do not require a lubricant to run. Several self- and solid-lubricated systems for the foils and the shafts are developed and tested in the last years.

Figure 4:
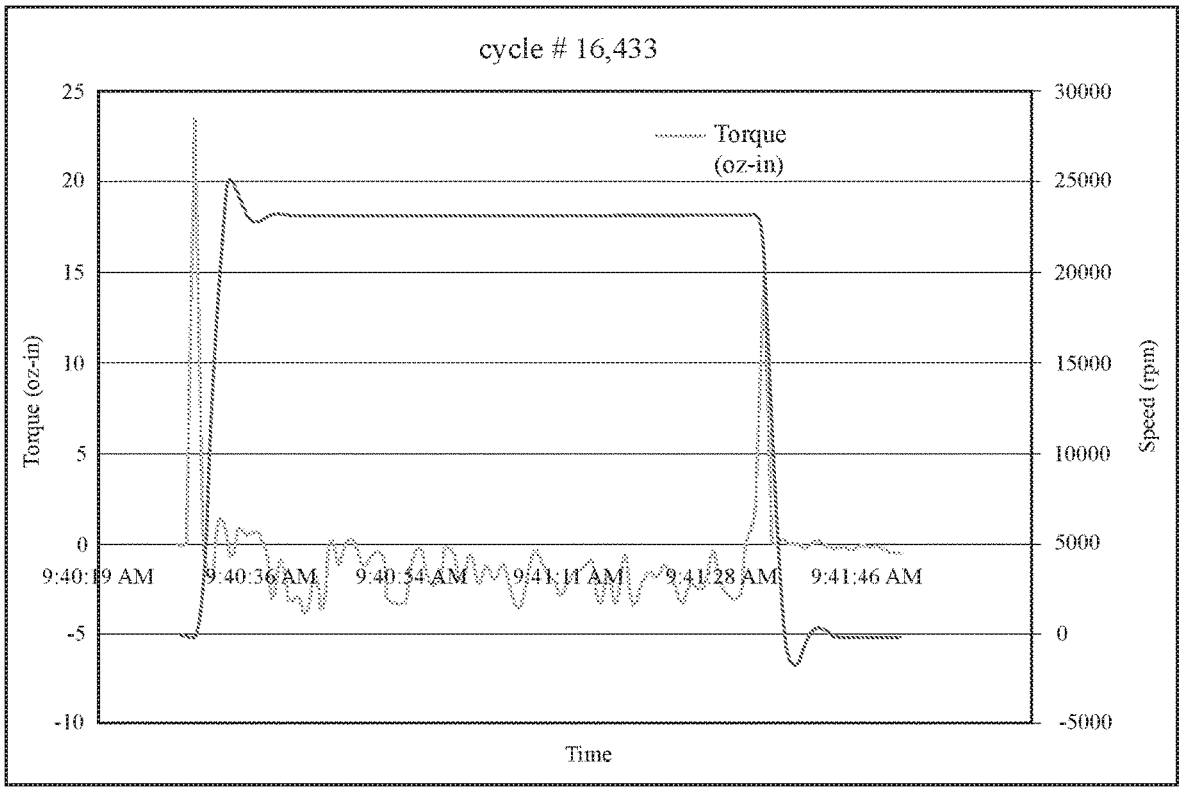
FIG. 4 is a typical lift-off cycles for one of the coatings that was typical over 20,000+ cycles.

The Fe-based thermal sprayed amorphous coatings on thin foils for foil air bearings applications were tested using the radial lift-off testing. The radial lift-off test rig features a high-speed spindle motor capable of 20,000 rpm that drives a rotor attached via a high-speed coupling and is used to test foil bearings. This test consists from ramping from zero speed to 24,000 rpm, hold for 1 min and returns to zero. This sequence is repeated over 20,000+ lift-off cycles. Thin foils were coated with Fe-based amorphous thermal sprayed coatings. A 50% torque reduction has been observed for the bearings with coated foils compared to the uncoated foils. A good coatings performance has also been observed. FIG. 4 is a typical lift-off cycles for one of the coatings that was typical over 20,000+ cycles.

Example 2

HVOF sprayed coatings were tested per G77 (block-on-ring) using L-MM46 hydrodynamic lubricating oil. The testing was performed against hardened 4130 block steel with a hardness of 30HRC, while the ring is coated with the material to be tested. The coatings were tested as following: 200N, 5 min→500N, 5 min→1000N, 5 min→1200N, 65 min The coatings were compared to the thermally sprayed molybdenum coatings known as solid lubricant. Fe-based coatings showed friction coefficient up to twice less than molybdenum coatings as shown in Table 5.

TABLE 5

Coefficients of Friction of Coatings

| Coating | Coefficient of Friction |
|---|---|
| Flame spray Molybdenum Coating | 0.12 |
| HVOF sprayed Fe-based coating 1 | 0.09 |
| HVOF sprayed Fe-based coating 2 | 0.07 |

Example 3

The adhesive wear test was performed per ASTM G99. This is a standard test method for wear testing with a Pin-on-Disk (PoD) apparatus and is generally used as a comparative test to study the tribological properties of the materials. The test requires two specimens: a pin-positioned perpendicular to the sample to be tested and the sample, usually a flat, circular disk. A ball, rigidly held, is often used as the pin specimen. The test machine causes either the disk specimen or the pin specimen to resolve about the disk center. In either case, the sliding path is a circle on the disk surface.

The coated sample is mounted on a moving stage, while a known force is applied on a pin or ball, in contact with the sample surface to create the wear. As the sample moves in a rotational motion, the resulting frictional forces between the pin and the sample are measured using a strain gage sensor on the arm. The, coefficient of friction, COF, is recorded in-situ. The volume of material lost is measured to calculate the wear rate of the material.

The thermally sprayed amorphous coatings were tested per ASTM G99 by applying 10N normal load, with a rotational speed of 0.25 m/s or 238.73 rpm and using a Si 3 N 4 ball 6 mm in diameter as a counterpart. The tests were performed at room temperature, 40% humidity and in dry environment (no lubricants). The results are summarized in Table 7.

TABLE 7

Coefficients of Friction of Various Coatings

| Coating | Average Friction Coefficient |
|---|---|
| Hard chrome | 0.70 |
| Stellite 6 | 071 |
| $Cr_3C_2$—NiCr | 0.66 |
| WC—CoCr | 0.87 |
| Nanostructured Wc-CoCr | 0.54 |
| Amorphous Fe-based coating | 0.12 |
| Amorphous Ni-based coating | 0.11 |

Example 4

Journal bearings are used in a wide variety of applications to support rotating shafts. When appropriately designed and maintained, journal bearings offer high load carrying capacity across a wide range of radial speeds with virtually unlimited life. These benefits can be realized with a simple sleeve supporting the journal and an adequate supply of lubricant, forgoing the expense and limited life of ball bearings or roller bearings.

To test amorphous thermal sprayed coatings as bearings material candidate, a dynamically loaded oscillatory test was performed. The test was done under a fixed load of 300 psi with an oscillating shaft at ±25 degrees for 100,000 cycles and under 600 F. This test helps to calculate the load carrying capability and wear life of bearing materials.

Sleeves coated with Fe-based amorphous materials were tested in comparison with uncoated sleeves. There was no evidence of galling or residue from the outer sleeve on the bushings-test in case of the coated sleeves, while a heavy wear has been detected in the uncoated sleeves. All coated samples were removed cleanly from the outer sleeve. There was no wear on coated sleeves after testing, while the wear depth of the uncoated sleeves varied between 0.002 and 0.006" (50.8 to 152.4 micrometer).

While the presently disclosed embodiments have been described in detail with reference to particularly preferred embodiments, those skilled in the art will appreciate that various modifications may be made thereto without significantly departing from the spirit and scope of the embodiments.

Accordingly, the foregoing description should not be read as pertaining only to the precise structures described and illustrated in the accompanying drawings, but rather should be read consistent with and as support to the following claims which are to have their fullest and fair scope.

The invention claimed is:

1. A method comprising:

solidifying a molten layer of a feedstock on a preexisting layer by controlling a heating source and a cooling rate so as to form an outermost layer comprising a partially amorphous alloy while avoiding formation of crystals in the molten layer and not affecting a crystalline structure of the preexisting layer, and phase-transforming the partially amorphous alloy into a fully amorphous alloy such that the outermost layer has a coefficient of friction (COF) of 0.15 or less;

wherein the fully amorphous alloy comprises $Fe_{100-(a++b+c+d)}(Cr_aX_bY_cZ_d)$, wherein: a is in a range of 10 to 50 at. %; b is in a range of 10 to 30 at. %; c is in a range of 2 to 10 at. %; and d is in a range of 0.5 to 10 at. %; or wherein the fully amorphous alloy comprises $Ni_{100-(a+b+c++d)}(Cr_aX_bY_cZ_d)$, wherein: a is in a range of 10 to 50 at. %; b is in a range of 10 to 30 at. %; c is in a range of 2 to 10 at. %; and d is in a range of 0.5 to 10 at. % wherein X, Y and Z are elements, wherein the Z is selected from the group consisting of boron, carbon and combinations thereof, wherein the X and the Y are selected from the group consisting of molybdenum, copper, cobalt, aluminum, titanium, tungsten, niobium, silicon, vanadium, and combinations thereof.

2. The method of claim 1, wherein the feedstock comprises $Fe_{100-(a+b+c+d)}(Cr_aX_bY_cZ_d)$, wherein: a is in a range of 10 to 50 at. %; b is in a range of 10 to 30 at. %; c is in a range of 2 to 10 at. %; and d is in a range of 0.5 to 10 at. %, or $Ni_{100-(a+b+c+d)}(Cr_aX_bY_cZ_d)$, wherein: a is in a range of 10 to 50 at. %; b is in a range of 10 to 30 at. %; c is in a range of 2 to 10 at. %; and d is in a range of 0.5 to 10 at. %.

3. The method of claim 1, further comprising thermal spraying the feedstock on the preexisting layer.

4. The method of claim 3, wherein the thermal spraying comprises high velocity oxygen fuel spraying, plasma spraying or arc spraying.

5. The method of claim 1, wherein the cooling rate is 100° C./s or slower and wherein the fully amorphous alloy is substantially free of phosphorus (P) and substantially free of boron (B).

6. The method of claim 1, wherein the method results in a partially crystalline layer beneath the outermost layer.

7. The method of claim 1, wherein an object formed by the method comprises a drill string, driving the drill string into a ground, and drilling a well in the ground; wherein the drill string comprises a drilling bit and a drill pipe connected thereto, wherein at least a portion of the drill pipe comprises a coating thereon.

8. The method of claim 1, wherein the fully amorphous alloy is substantially free of phosphorus (P) and substantially free of boron (B).

9. The method of claim 8, wherein the fully amorphous alloy contains less than 10 at. % of P and less than 10 at. % of B.

10. The method of claim 9, wherein the fully amorphous alloy contains less than 1 at. % of P.

11. The method of claim 9, wherein the fully amorphous alloy contains no P.

12. The method of claim 8, wherein the fully amorphous alloy comprises Fe, Cr, X, Y and Z, wherein: X, Y and Z are elements, and the Y is selected from the group consisting of boron, carbon and combinations thereof.

13. The method of claim 8, wherein the fully amorphous alloy comprises Ni, Cr, X, Y and Z, wherein: X, Y and Z are elements, and the Z is selected from the group consisting of boron, carbon and combinations thereof.

14. The method of claim 1, wherein the feedstock is fully amorphous.

15. The method of claim 1, wherein the feedstock is partially amorphous.

16. A method comprising:

solidifying a molten layer of a feedstock on a preexisting layer by controlling a heating source and a cooling rate so as to form an outermost layer comprising a partially amorphous alloy, and phase-transforming the partially amorphous alloy into a fully amorphous alloy such that the outermost layer has a coefficient of friction (COF) of 0.15 or less;

wherein the fully amorphous alloy comprises $Fe_{100-(a+b+c+d)}(Cr_aX_bY_cZ_d)$, wherein: a is in a range of 10 to 50 at. %; b is in a range of 10 to 30 at. %; c is in a range of 2 to 10 at. %; and d is in a range of 0.5 to 10 at. %; or wherein the fully amorphous alloy comprises $Ni_{100-(a+b+c+d)}(Cr_aX_bY_cZ_d)$, wherein: a is in a range of 10 to 50 at. %; b is in a range of 10 to 30 at. %; c is in a range of 2 to 10 at. %; and d is in a range of 0.5 to 10 at. %;

wherein X, Y and Z are elements, wherein the Z is selected from the group consisting of boron, carbon and combinations thereof, wherein the X and the Y are selected from the group consisting of molybdenum, copper, cobalt, aluminum, titanium, tungsten, niobium, silicon, vanadium, and combinations thereof.

* * * * *